United States Patent [19]

Ford

[11] 4,041,566

[45] Aug. 16, 1977

[54] PAINT BRUSH BRISTLE SHAPING DEVICE

[76] Inventor: Norman F. Ford, R.D. No. 2, Clymer, Pa. 15726

[21] Appl. No.: 680,495

[22] Filed: Apr. 26, 1976

[51] Int. Cl.[2] ..... A46B 17/00

[52] U.S. Cl. ..... 15/257 R

[58] Field of Search ..... 15/257 R; 248/113

[56] References Cited

U.S. PATENT DOCUMENTS

| | | | |
|---|---|---|---|
| 2,466,661 | 4/1949 | Massey | 15/257 R |

FOREIGN PATENT DOCUMENTS

| | | | |
|---|---|---|---|
| 357,054 | 2/1938 | Italy | 15/257 R |
| 275,746 | 9/1951 | Switzerland | 15/257 R |
| 315,280 | 9/1956 | Switzerland | 15/257 R |

*Primary Examiner*—Edward J. McCarthy
*Attorney, Agent, or Firm*—Paul Bogdon

[57] ABSTRACT

A device for providing a shape to the bottoms of the bristles of a conventional paint brush is disclosed. The purpose of the device is to give the bristles a particular shape for using the brush in landscape painting. The device has a spring clip type of a holder for securing the brush and a base section below the holder. The base section may have a variety of shapes such as a flat central portion and flared out side sections whereby the bundle of bristles of a brush pushed against the base will assume a shape having flared out sides and a flat bottom. Such a brush will provide a desired landscape representation when paint is applied with the brush to a canvas or the like. Other shapes of the base section are disclosed.

10 Claims, 10 Drawing Figures

PAINT BRUSH BRISTLE SHAPING DEVICE

BACKGROUND OF THE INVENTION

The inventor of the present invention has developed a technique of painting landscapes on canvas or other suitable surfaces by using conventional type paint brushes such as would be used in painting wall surfaces or the like. Different landscape representations are obtained depending on how the paint brush is patted onto the surface. For example, distant tree representations are obtained by holding the brush with the end of the bristle bundle in a vertical position and lightly patting the surface. Shrubbery representations may be obtained by pushing the brush onto the surface so that the bristles flare to the left. The representation of tree leaves may be obtained by pressing the brush against the surface so that the bristles flare in both the left and right directions. Many other various landscape effects may be achieved depending on how the painter causes the bristles of the brush to spread or flare.

When a painter perfects the inventor's broad brush landscape painting technique he knows the degree and direction of pressure to be used on the painting surface to produce the desired representations. However, an inexperienced painter might encounter difficulty in applying the required brush spreading or flaring pressure and might apply too little or too much pressure and as a result the desired representation will not be achieved. In view of that, the inventor found that it would be desireable to provide a set to the bristles of the brush so that all that need be done to achieve a representation would be to dab the paint onto the canvas without the necessity of applying any pressure. The painter could have a variety of brushes each having its bristles formed into a different flare shape. Whenever a certain landscape representation was desired the painter would achieve it by using the brush having its bristles shaped to provide that representation. The purpose of the present invention is to give a desired bristle shape to a paint brush whereby the bristles of the brush may be set into the shape and be ready to be used with the inventor's broad brush landscape technique.

SUMMARY OF THE INVENTION

The present invention provides a paint brush bristle shaping device which preferably comprises holding means for receiving and holding a conventional paint brush; and a base section spaced from the holding means and having a central portion lying generally in a plane normal to the longitudinal center line of a brush held by the holding means and side portions, with the central portion and the side portions being constructed and arranged to shape the bottoms of the bristles of a brush into a generally flared pattern adapted for landscape painting. The base section is provided with various shapes designed to provide different bristle flare patterns. In its simplest shape the base is flat, while another shape has outwardly flared side sections. Yet another base section shape would be a flat central portion with one side section coplanar with the central portion and the other side section at a right angle to the central portion. Another configuration would have the sides pivotably connected to the central portion whereby the bristle side flare could be adjusted as desired by selectively positioning the sides. In another configuration, the central portion of the base is provided with a protruded section whereby the bristle bundle has an indentation. Various other configurations are available. In using any configuration, the brush is secured to the device by forcing it into the holder so that the bristles engage the base section which gives the bottoms of the bristles the desired shape. The bristles are wetted with water, shellac or the like and allowed to set while in the device. When the bristles are set and dry the brush is ready for use in painting a landscape.

Various other advantages, details and modifications of the present invention will become apparent as the following descriptions of certain present preferred embodiments thereof proceed.

BRIEF DESCRIPTION OF THE DRAWING

In the accompanying drawings I have shown certain present preferred embodiments of the present invention in which.

Figure 1:
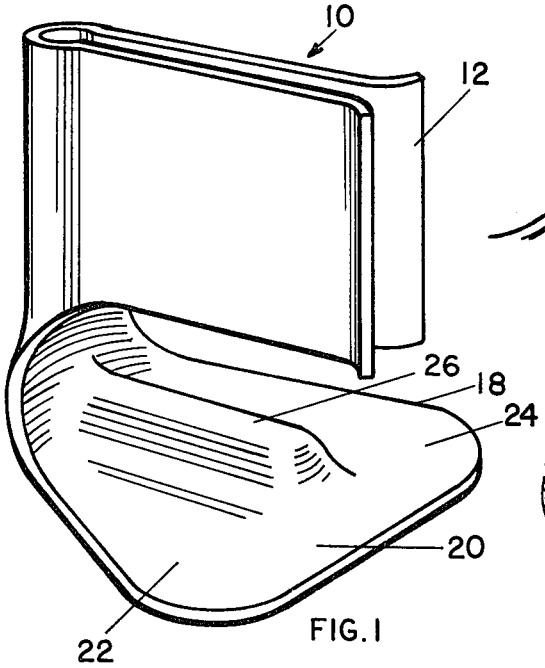
FIG. 1 is a perspective view of one embodiment of the paint brush bristle shaping device of the present invention showing the base member thereof with a protruded section.
Figure 3:
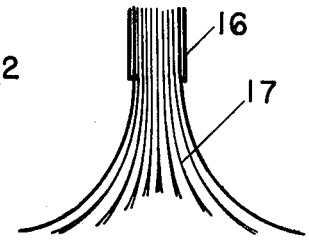
FIG. 3 is a sectional view in elevation through the bristles of the brush of FIG. 2 showing the flared pattern of the bristles.
Figure 2:
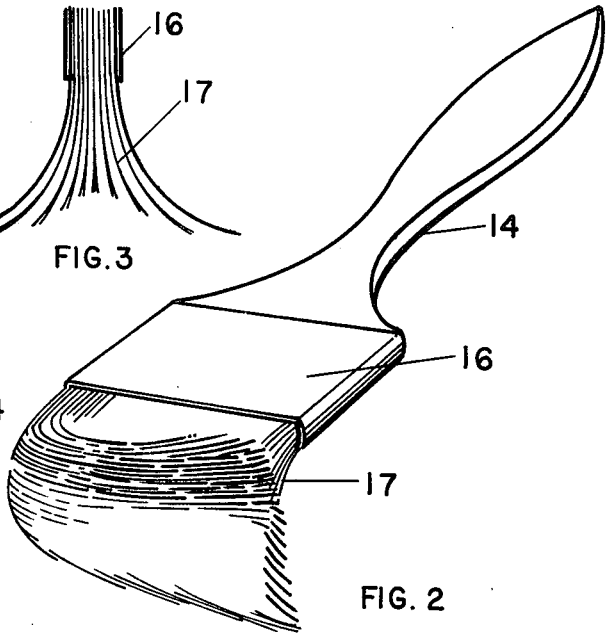
FIG. 2 is a perspective view of a conventional paint brush with its bristles in a set flared pattern as would be obtained by using the brush with the device of FIG. 1.

Referring now to the drawings, and particularly to FIGS. 1–3, there is shown in FIG. 1 one embodiment of a paint brush bristle shaping device of the present invention generally designated by the numeral 10. The device 10 is formed of a resilient, flexible material, such as any suitable plastic, and includes a paint brush holding means in the form of a clip 12 having a pair of generally parallel flat arms connected at their inner ends and opened at their outer ends to snugly receive the ferrule 16 of a conventional paint brush 14. With the device 10 positioned as shown in FIG. 1 a paint brush 14 would be held in a generally vertical position by the clip 12. A base portion or member 18 is integrally connected with the clip 12 and has a central portion 20 spaced from the clip and lying in a plane normal to the plane passing through the vertical mid section of the clip whereby the longitudinal centerline of the brush 14 held by the clip 12 would also be normal to the plane of the central portion. Base member 18 also includes a pair of side sections 22 and 24 which are generally triangular in section. In the device 10 of FIG. 1 the side sections 22 and 24 are coplanar with the central portion 20 to form a generally fan-shaped base member 18. The central portion 20 is provided with a raised hump or protruded section 26 extending centrally of the central portion to a point near the free outer end of the central portion.

When using the shaping device 10 of FIG. 1 the paint brush 14 is inserted at its ferrule 16 into clip 12 and in doing so the bottoms of the bristles 17 engage with the base member 18 and flare out in the form shown in FIGS. 2 and 3. The protruded section 26 of the base member causes the center portion of the bottom of the bristles 17 to have an indented shape while the generally flat side sections 22 and 24 cause the side section of the bottom of the bristles to be generally flat. The bristles 17 would be wetted with water or with a suitable shellac or other bristle setting agent prior to putting the brush 14 into the device 10. The brush 14 would be allowed to remain in the device 10 for as long as it is necessary to set the bristles 17 in the shape shown in FIGS. 2 and 3. At that stage the brush 14 may be removed from the device 10 and is ready to be used in painting a landscape.

Figure 4:
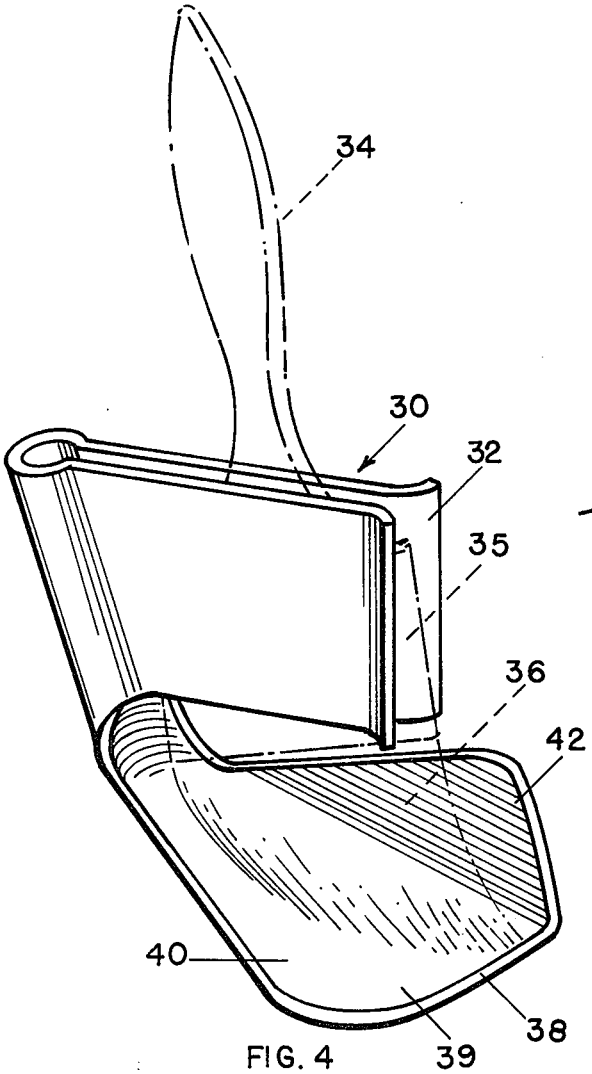
FIG. 4 is a perspective view of another embodiment of the device of the present invention showing one side of the base member at a right angle to the central portion and also showing in phantom outline a paint brush being held by the device in a bristle shaping position.
Figure 6:
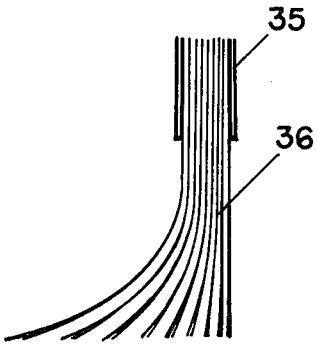
FIG. 6 is a sectional view in elevation through the bristles of the brush of FIG. 5 showing the flared pattern of the bristles.
Figure 5:
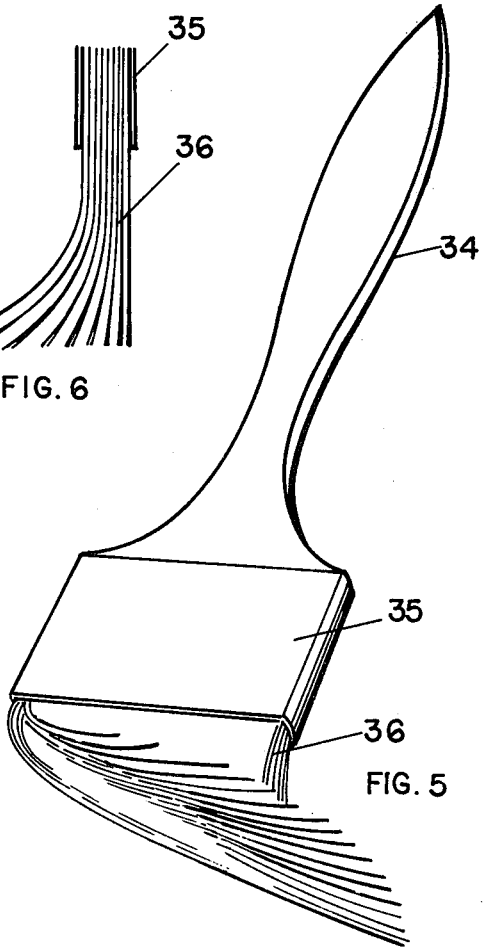
FIG. 5 is a perspective view of a conventional paint brush with its bristles in a flared pattern as would be obtained by using the device of FIG. 4.

FIG. 4 shows another embodiment of the paint brush bristle shaping device of the present invention and is generally designated by the numeral 30. Device 30 functions essentially the same as the device 10 and differs in the bristle shape it provides to a paint brush. Device 30 is also formed of a resilient flexible material and includes a clip 32 for securely holding a paint brush 34 by its ferrule 35 in such a manner that the bristles 36 engage the base member 38 to shape the bristles in the form shown in FIGS. 5 and 6. Base member 38 has a central portion 39 aligned with and generally normal to the vertical plane through the center of the clip 32. A flat side section 40 is integral with the central portion 39 and is generally coplanar therewith. Another side section 42 is also integral with the central portion but at right angles therewith. Thus when using the device 30 of FIG. 4, the paint brush 34 is inserted in the clip 32, as shown in phantom outline, and the bottom bristles 36 engaged with the base member 38 to take on a side flared shape. The wetted brush 34 is allowed to stay in the device 30 until the bristles 36 set at which time the brush is ready for use in painting landscapes. The bristles 36 shown in FIGS. 5 and 6 are in a left flare configuration and if a right flare is desired, the brush would be turned 180° from the orientation shown in the figures.

Figure 7:
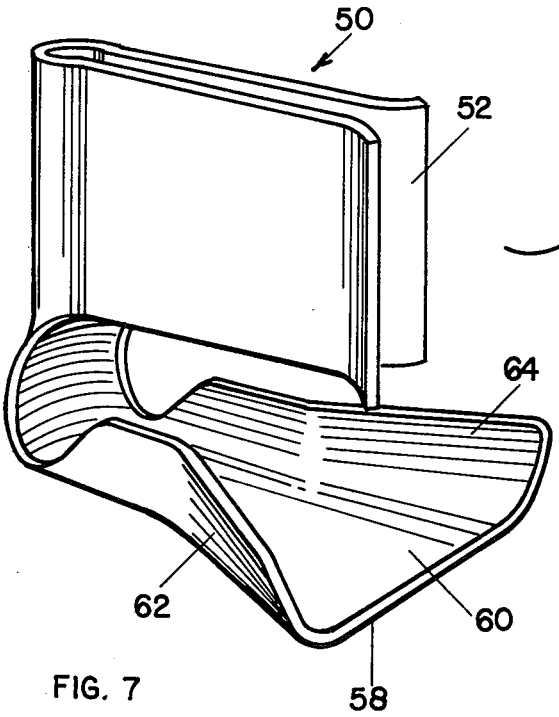
FIG. 7 is a perspective view of yet another embodiment of the present invention showing both sides of the base member flared outwardly at an obtuse angle to the central portion of the base member.
Figure 9:
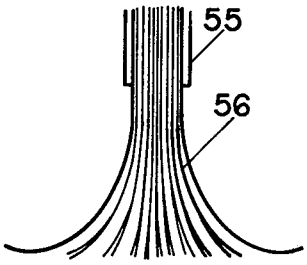
FIG. 9 is a sectional view in elevation through the bristles of the brush of FIG. 8 showing the flared pattern of the bristles.
Figure 8:
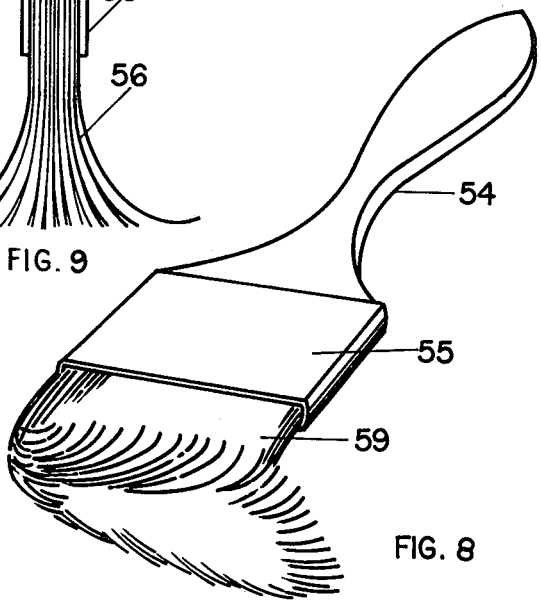
FIG. 8 is a perspective view of a conventional paint brush with its bristles in a flared pattern as would be obtained by using the device of FIG. 7.

Yet another embodiment of the device of the present invention is shown in FIG. 7 and is generally identified by the numeral 50. Device 50 is formed of a resilient plastic material and has a clip 52 for holding the conventional paint brush 54 about its ferrule 55 so that the bottoms of the bristles 56 engage the base member 58 which is spaced from and integrally connected to the clip 52. Base member 58 has a flat central portion 60 aligned with and at right angles to the vertical plane of the center of clip 52 and oppositely disposed, outwardly flared side sections 62 and 64 integrally formed at an obtuse angle with the central portion 60 in the manner shown in FIG. 7. As with the previously described devices, the brush 54 is secured to the device 50 with the bristles 56 suitably wetted and allowed to remain until the bottoms of the bristles set in the double flared shape as shown in FIGS. 8 and 9. Upon setting of the bristles 56, the brush 54 is ready for use in painting landscapes.

Figure 10:
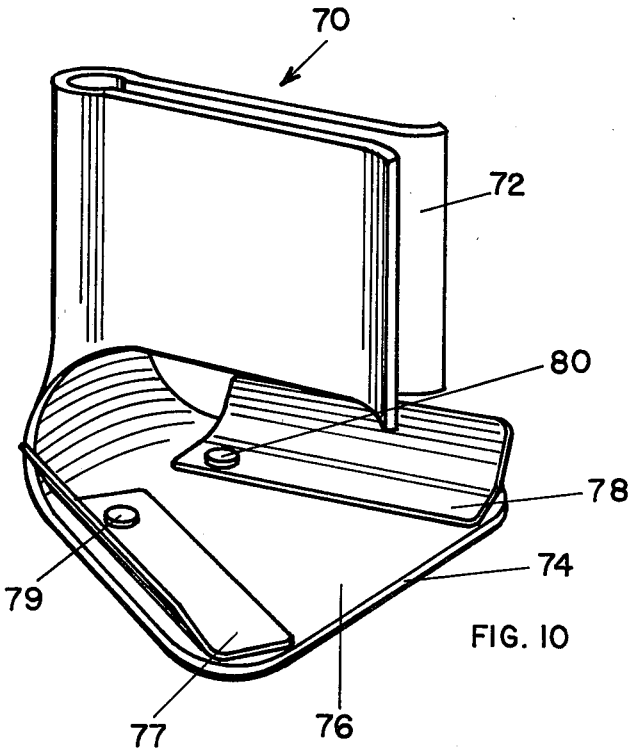
FIG. 10 is a perspective view of still another embodiment of the device of the present invention showing both sides flared outwardly and pivotable with respect to the central portion of the base member.

Still another embodiment of the device of the present invention is shown in FIG. 10 and is generally designated by the numeral 70. The device 70 is essentially the same as the device 50 of FIG. 7, having a clip 72 and a base member 74 with a flat central portion 76 aligned at right angles to the vertical central plane of the clip 72. Device 70 differs from device 50 in that the base member 74 of device 70 is provided with outwardly flared side sections 77 and 78 pivotably connected at 79 and 80 with central portion 76 at their respective inner ends such that the side sections are selectively pivotable about axes extending at right angles to the plane of the central portion. The device 70 will provide a double flare-flat bottom pattern to the bristles of a paint brush, much the same as is provided by the device 50 as shown in FIGS. 8 and 9. The degree of the flare, however, may be varied by using device 70 simply by adjusting the position of the pivotable side sections 76 and 78 as desired.

It should now be clearly understood how the various devices of the present invention as described above provide different bristle bundle shapes to conventional paint brushes. It should be also understood that the brushes as shaped by the present invention are particularly suited for use in the broad brush landscape painting technique as developed by the inventor.

While I have shown and described certain embodiments of this invention, it is to be distinctly understood that the invention is not limited thereto, but may be otherwise variously embodied within the scope of the following claims.

I claim:

1. A paint brush bristle shaping device comprising:

holding means for receiving a paint brush and holding the brush; and a base section spaced from said holding means and having a central portion lying in a plane normal to the longitudinal center line of a brush held by said holding means and side portions extending outwardly from said central portion with at least one of side portions having a flat surface, with said central and side portions being constructed and arranged to shape and retain the bottoms of the bristles of a brush into a generally flared pattern adapted for landscape painting whereby when a setting agent is applied to the bristles the retained shape will be held by the bristles when the brush is removed from the device.

2. A paint brush bristle shaping device as set forth in claim 1 wherein said holding means is a clip formed of two generally flexible arms arranged to snugly receive the ferrule portion of a paint brush.

3. A paint brush bristle shaping device as set forth in claim 1 wherein said central portion of said base section includes a protruded section shaped to provide an indented form to the center of the bristles of a paint brush.

4. A paint brush bristle shaping device as set forth in claim 1 wherein at least one of said side portions of said base section is in a plane at an obtuse angle to the plane of said central portion.

5. A paint brush bristle shaping device as set forth in claim 1 wherein said side portions of said base section are coplanar with the plane of said central portion.

6. A paint brush bristle shaping device as set forth in claim 1 wherein one of said side portions of said base section is in a plane normal to the plane of said central portion.

7. A paint brush bristle shaping device as set forth in claim 1 wherein at least one of said side portions of said base section is pivotable with respect to said central portion about an axis normal to said central portion.

8. A paint brush bristle shaping device as set forth in claim 1 wherein said central portion of said base section is generally fan-shaped, and wherein both of said side sections are in planes at obtuse angles to the plane of said central portion.

9. A paint brush bristle shaping device as set forth in claim 8 wherein both of said side sections are pivotable with respect to said central portion about axes normal to said central portion.

10. A paint brush bristle shaping device as set forth in claim 6 wherein the other of said side portions is coplanar with said central portion.

* * * * *